US006400249B1

(12) United States Patent
Jitaru

(10) Patent No.: US 6,400,249 B1
(45) Date of Patent: Jun. 4, 2002

(54) TRANSFORMER PROVIDING LOW OUTPUT VOLTAGE

(75) Inventor: Ionel Jitaru, Tucson, AZ (US)

(73) Assignee: Ascom Energy Systems AG, Berne (CH)

( * ) Notice: Subject to any disclaimer, the term of this patent is extended or adjusted under 35 U.S.C. 154(b) by 0 days.

(21) Appl. No.: 09/740,315

(22) Filed: Dec. 18, 2000

(51) Int. Cl.[7] ..... H01F 27/24
(52) U.S. Cl. ..... 336/212; 336/215; 336/214
(58) Field of Search ..... 336/215, 212, 336/214, 170

(56) References Cited

U.S. PATENT DOCUMENTS 3,846,673 A * 11/1974 Hirota et al. ..... 315/400
5,204,653 A * 4/1993 Saitoh et al. ..... 336/178
5,416,458 A * 5/1995 Menke et al. ..... 336/12
5,930,095 A * 7/1999 Joo et al. ..... 361/58

* cited by examiner

*Primary Examiner*—Anh Mai
(74) *Attorney, Agent, or Firm*—Birdwell, Janke & Durando, PLC

(57) ABSTRACT

A transformer providing low output voltage. A transformer core has two outer leg portions and a center portion. A primary winding has a first portion looped around one of the legs so that a current passed through the first winding will produce a magnetic flux in that leg that circulates in either the right hand or left hand sense. A second portion of the input signal winding is looped around the other leg in the opposite sense. This provides for a magnetic flux circulating through the two outer leg portions in the same sense, and provides that the magnetic flux circulating through the center portion is zero. The secondary winding is preferably provided as a fractional loop around one of the outer legs.

13 Claims, 6 Drawing Sheets

TRANSFORMER PROVIDING LOW OUTPUT VOLTAGE

BACKGROUND OF THE INVENTION

The present invention relates to a planar transformer providing low output voltage, particularly a planar transformer for use in DC-DC power converters.

As microprocessors and other integrated semiconductor devices become denser, it is desirable to lower their supply voltage requirements. Accordingly, supply voltages for digital electronics have been reduced from 5 volts to 3.3 volts, then to 2.5 volts, and are now being reduced to 1.6 volts. The trend is expected to continue.

A power converter for supplying the integrated circuits typically employs a transformer to accept an input at a relatively high voltage and produce a lower output voltage. As is well known, standard transformers typically employ a ferrite core around which wires forming primary (input) and secondary (output) circuits are wound. These standard transformers are notoriously expensive and bulky however, and alternative transformer embodiments have been used in computer power supplies to lower cost and decrease size. One such embodiment is the "planar" transformer, wherein the wires are replaced by traces in one or more layers of a circuit board.

The prior art transformer has a limitation in the output voltage that it is capable of producing. Particularly, magnetic technology has typically been limited to the output voltage that is produced by one turn of the secondary. To address this limitation, fractional turns have been employed. Referring to FIG. 1 as an example, a core 2 is shown having a center leg 3 around which a primary winding 4 is looped. The core 2 has two secondary "legs" 6*a* and 6*b*, and a secondary winding 8 is looped around one of the legs 6*a* one half-turn. A problem with this transformer is that magnetic flux circulating from the center leg through the other leg 6*b* leads to an undesirable leakage inductance.

To address this problem, referring to FIG. 2, a half-turn of the secondary 8 is looped around the leg 6*a* and a half-turn is looped around the leg 6*b*. The two loops contribute to the total output voltage in parallel, and all of the flux in the core links the secondary. However, a problem remains in that the two legs 6*a* and 6*b* are not identical, so that the magnetic flux through the respective half-turns is not identical. In response, an additional circulating current flows in the secondary in order to balance the magnetic flux, leading to additional ohmic power loss.

Another problem with the prior art as shown in FIG. 2 is that the secondary 8 winding is relatively long compared to the secondary winding shown in FIG. 1. This also increases ohmic loss in the transformer, and in addition increases stray inductance.

Accordingly, there is a need for a transformer providing low output voltage that provides for converting substantially all the magnetic flux circulating in the core of a transformer into an output current, particularly by decreasing ohmic loss and stray inductance.

SUMMARY OF THE INVENTION

The transformer providing low output voltage of the present invention solves the aforementioned problems and meets the aforementioned needs by providing a magnetic core having at least two apertures defining a center portion between the apertures and two leg portions. The core has primary and secondary windings. The primary winding receives a first voltage or current and induces a second voltage or current in the secondary winding. The input power is typically though not necessarily provided at a higher voltage than the output power, the latter which is preferably less than or substantially equal to 3.3 volts.

The primary winding has a first portion looped around one of the leg portions so that a current passed through the first winding will produce a magnetic flux in that leg portion that circulates in either the right hand or left hand sense. A second portion of the primary winding is looped around the other leg portion in the opposite sense. This provides for a magnetic flux circulating through the two outer leg portions in the same sense, and provides that the magnetic flux circulating through the center portion is zero. The secondary winding is preferably provided as a fractional loop around one of the outer leg portions.

Therefore, it is a principal object of the present invention to provide a novel and improved transformer providing low output voltage.

It is another object of the present invention to provide a transformer providing low output voltage that provides for converting substantially all the magnetic flux circulating in the core of a transformer into an output current.

It is yet another object of the present invention to provide a transformer providing low output voltage that provides for high efficiency.

It is still another object of the invention to provide a transformer providing low output voltage that provides for minimal leakage inductance.

It is a further object of the present invention to provide a transformer providing low output voltage that provides for minimal ohmic loss.

It is still a further object of the present invention to provide such a transformer at lower cost.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 1:
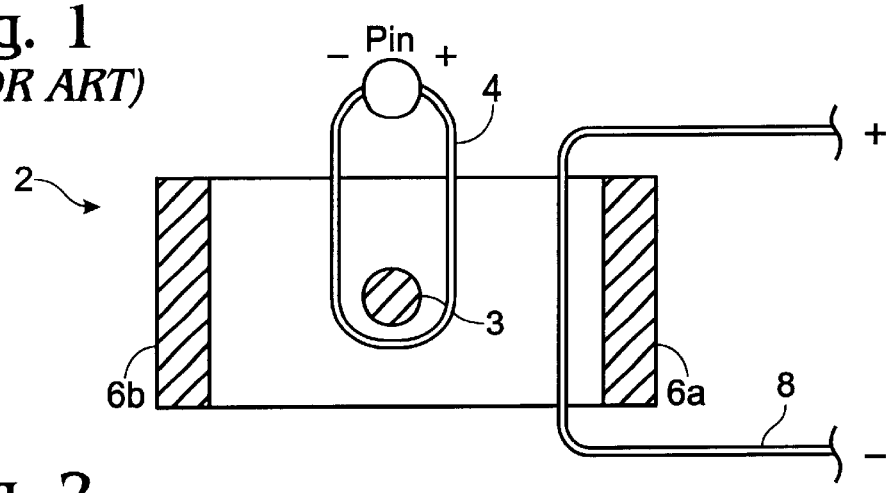
Fig. 1 (PRIOR ART)
FIG. 1 is a pictorial schematic of a prior art planar transformer shown in horizontal cross-section.
Figure 2:
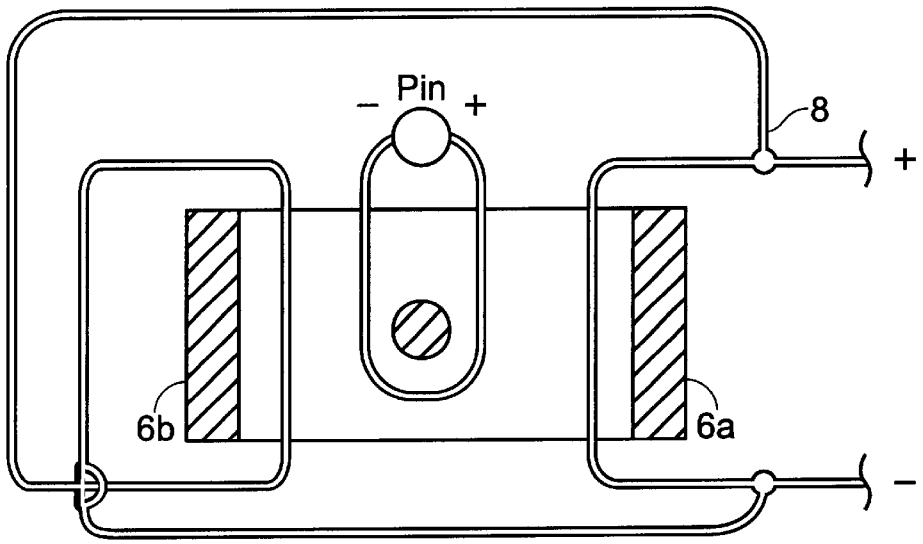
Fig. 2 (PRIOR ART)
FIG. 2 is a pictorial schematic of another prior art planar transformer shown in horizontal cross-section.
Figure 3:
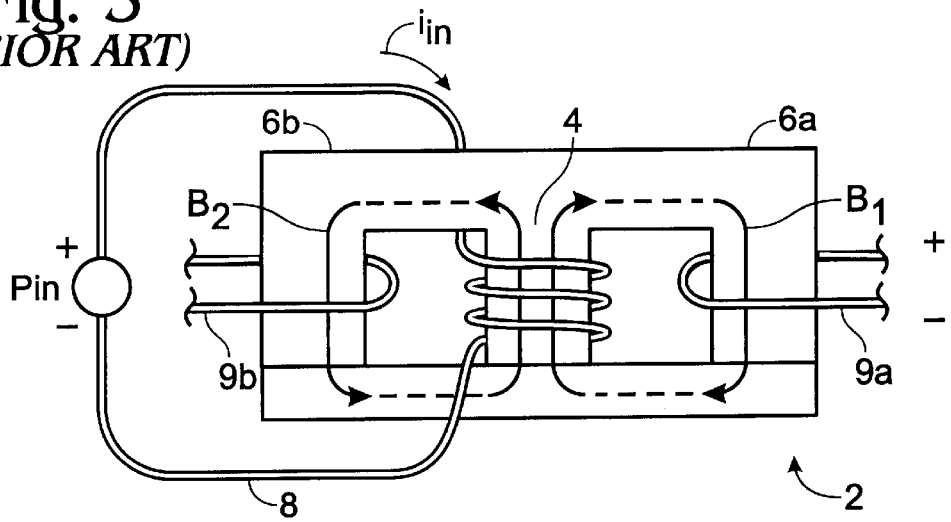
Fig. 3 (PRIOR ART)
FIG. 3 is a pictorial schematic of a prior art transformer shown in side elevation.

As discussed above, FIGS. 1 and 2 illustrate prior art transformers providing low output voltage as a result of employing fractional turns or loops in the secondary winding. Shown in FIGS. 1 and 2 are half-turns; however, other fractions of turns may be employed. Turning to FIG. 3, the principal of their operation is clarified to further a comparison with the present invention. A core 2 has a center portion 4 and two leg portions 6*a* and 6*b*. A primary winding 8 is coupled to a source of voltage or current $P_{in}$. The primary winding is looped around the leg portions so that current $i_{in}$ flowing through the winding produces a magnetic flux "$B_1$" in the leg portion 6*a* and "$B_2$" in the leg portion 6*b*. The flux "$B_1$" circulates in one of the right hand or left hand sense, depending on the direction of the current $i_{in}$, and the flux "$B_2$" circulates in the other sense, so that two independent paths of magnetic flux are operative. Twice the magnetic flux that is present in each leg portion 6 circulates through the center portion 4.

In an embodiment of the transformer of FIG. 3 that corresponds to that of FIG. 1, one secondary winding 9*a* is looped around one of the leg portions 6*a*. Similarly, in an embodiment of the transformer of FIG. 3 corresponding to that of FIG. 2, two secondary windings 9*a* and 9*b* are looped, respectively, around the leg portions 6*a* and 6*b*.

Figure 4:
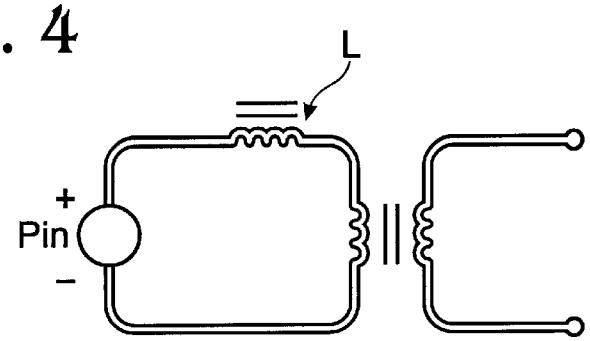
FIG. 4 is a schematic of a circuit equivalent to the prior art transformer of FIG. 1.

In the embodiment corresponding to FIG. 1, the winding 9*a* encircles all of the magnetic flux "$B_1$" but none of the magnetic flux "$B_2$." The magnetic flux "$B_1$" is therefore transformed or converted to current flow in the winding 9*a* wherein the current flows in the winding 9*a* so as to cancel the magnetic flux "$B_1$." However, due to the lack of a winding 9*b*, the magnetic flux "$B_2$" is not converted to current flow, so that the magnetic flux "$B_2$" is not canceled and remains in the core, leading to leakage inductance. FIG. 4 shows the equivalent circuit of the embodiment of FIG. 1, showing the leakage inductance "L."

Alternatively, in the embodiment of the transformer of FIG. 3 that corresponds to that of FIG. 2, all of the magnetic flux is transformed or converted to current flow only if perfect symmetry is achieved in the windings 9. Since this is not possible, there remains an uncanceled magnetic flux and consequently a remaining leakage inductance. In addition, connecting the windings 9*a* and 9*b* in the manner of the winding 8 in FIG. 2 ensures that there will be an increased ohmic loss as well as increased stray inductance.

Figure 5A:
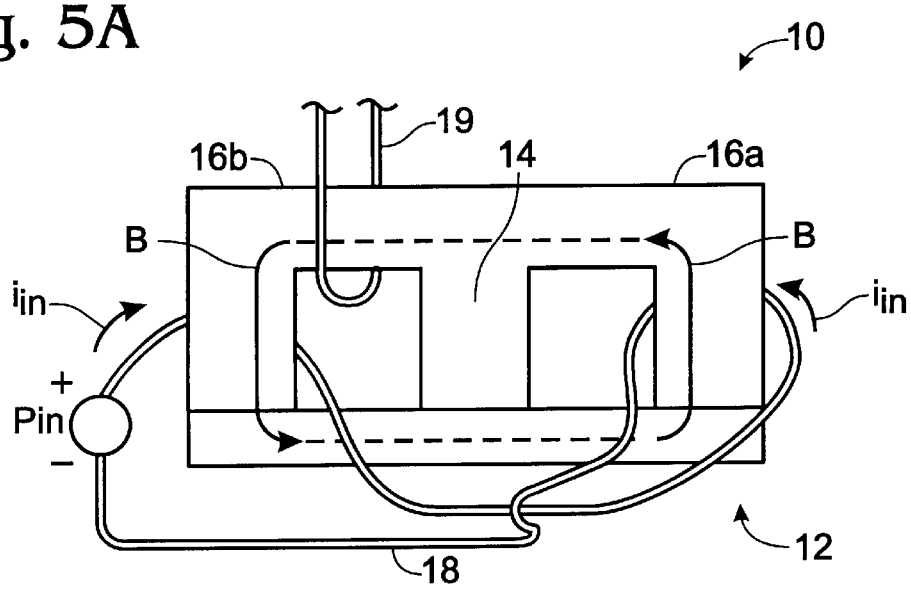
FIG. 5A is a pictorial schematic of a transformer providing a low output voltage according to the present invention shown in side elevation.

Turning now to FIG. 5A, a simplified embodiment of a transformer 10 providing low output voltage according to the present invention is shown to illustrate an outstanding principle of the invention. A core 12 has a center portion 14 and two leg portions 16*a* and 16*b*. A primary winding 18 is coupled to a source of voltage or current $P_{in}$. The primary winding is looped around the leg portions so that current $i_{in}$ flowing through the winding produces a magnetic flux "B" in each leg portion that circulates in one of either the right hand or left hand sense as shown by the arrows. Because of the novel arrangement of the primary winding 18, no magnetic flux circulates through the center portion 14. Particularly, the primary winding is not wound around the center portion 14 as in the prior art, but is instead wound around the leg portions 16*a* and 16*b*.

Figure 5B:
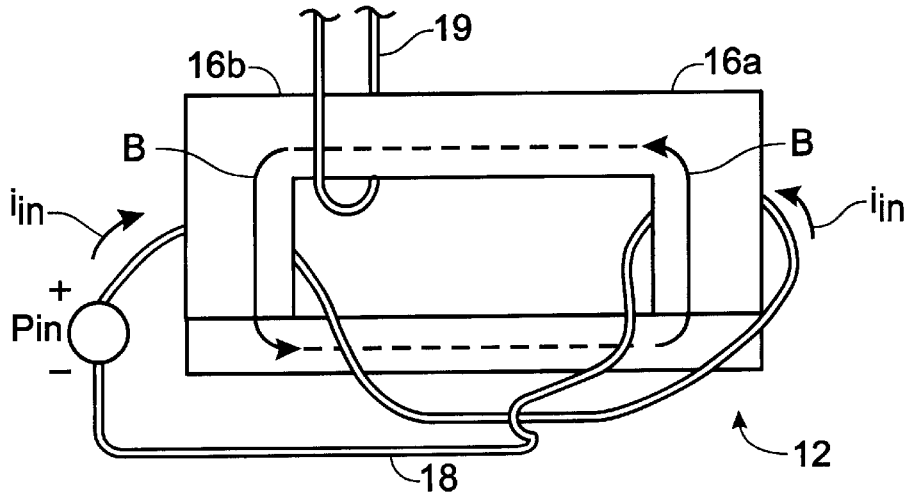
FIG. 5B is a pictorial schematic of the transformer of FIG. 5A with the center portion removed.

A secondary winding 19 may be looped around either of the leg portions 16, and preferably both of the leg portions to provide symmetry. The single turn encloses all of the flux B without the need for creating perfect symmetry in two separate windings. Accordingly, the transformer may be provided with higher efficiency at lower cost, and has a minimal or zero leakage inductance. Turning to FIG. 5B, this is particularly so where the center portion 14 has been removed from the core 12. While the center portion may be employed for other purposes, such as described below and such as described in the present inventor's companion application entitled METHOD AND APPARATUS FOR TRANSMITTING A SIGNAL THROUGH A POWER MAGNETIC STRUCTURE, executed on even date herewith, its removal prevents any remaining asymmetry in magnetic flux through the leg portions to lead to leakage inductance by virtue of magnetic flux circulating through the center portion.

Figure 6:
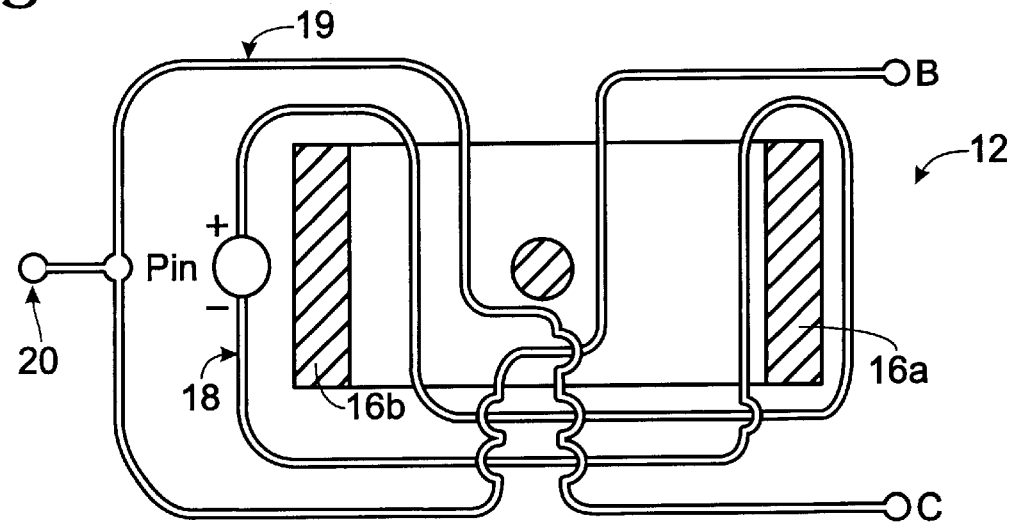
FIG. 6 is a pictorial schematic of a center tap embodiment of a transformer providing a low output voltage according to the present invention shown in horizontal cross-section.
Figure 7:
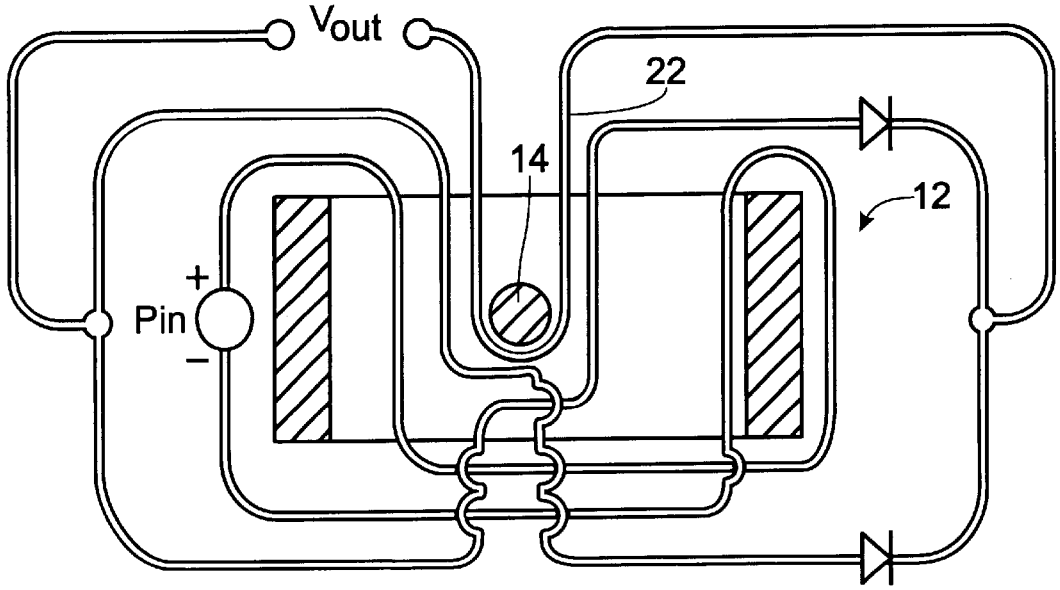
FIG. 7 is a pictorial schematic of the center tap embodiment of a transformer providing a low output voltage of FIG. 6 in a power converter circuit employing an integrated choke.

Referring to FIG. 6 a "center-tap" embodiment of the invention is shown. The secondary winding 19 forms a "figure eight" pattern that results in looping a fractional turn around the leg portion 16*a* in one of the right or left hand sense, and continues so as to loop a full turn around the other leg portion 16*b* in the opposite sense. The center portion 14 is unused. A node 20 lies on the winding 19 forming the center tap with respect to ends B and C. FIG. 7 shows the embodiment of FIG. 6 configured as a power converter with an integrated output filtering choke 22 employing the center portion 14 of the core 12.

Figure 8:
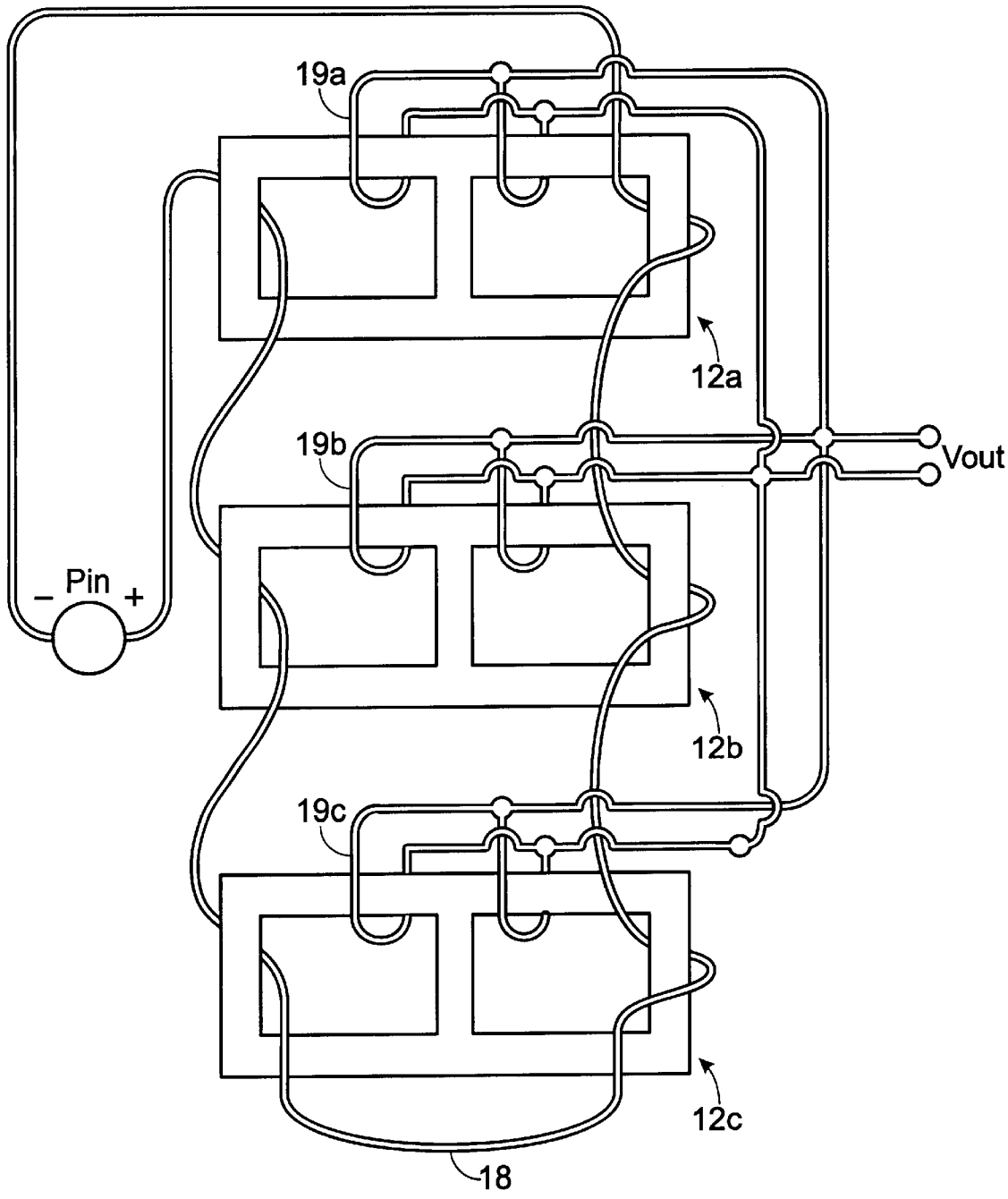
FIG. 8 is a pictorial schematic of a multiple core embodiment of the transformer of FIG. 5.
Figure 9:
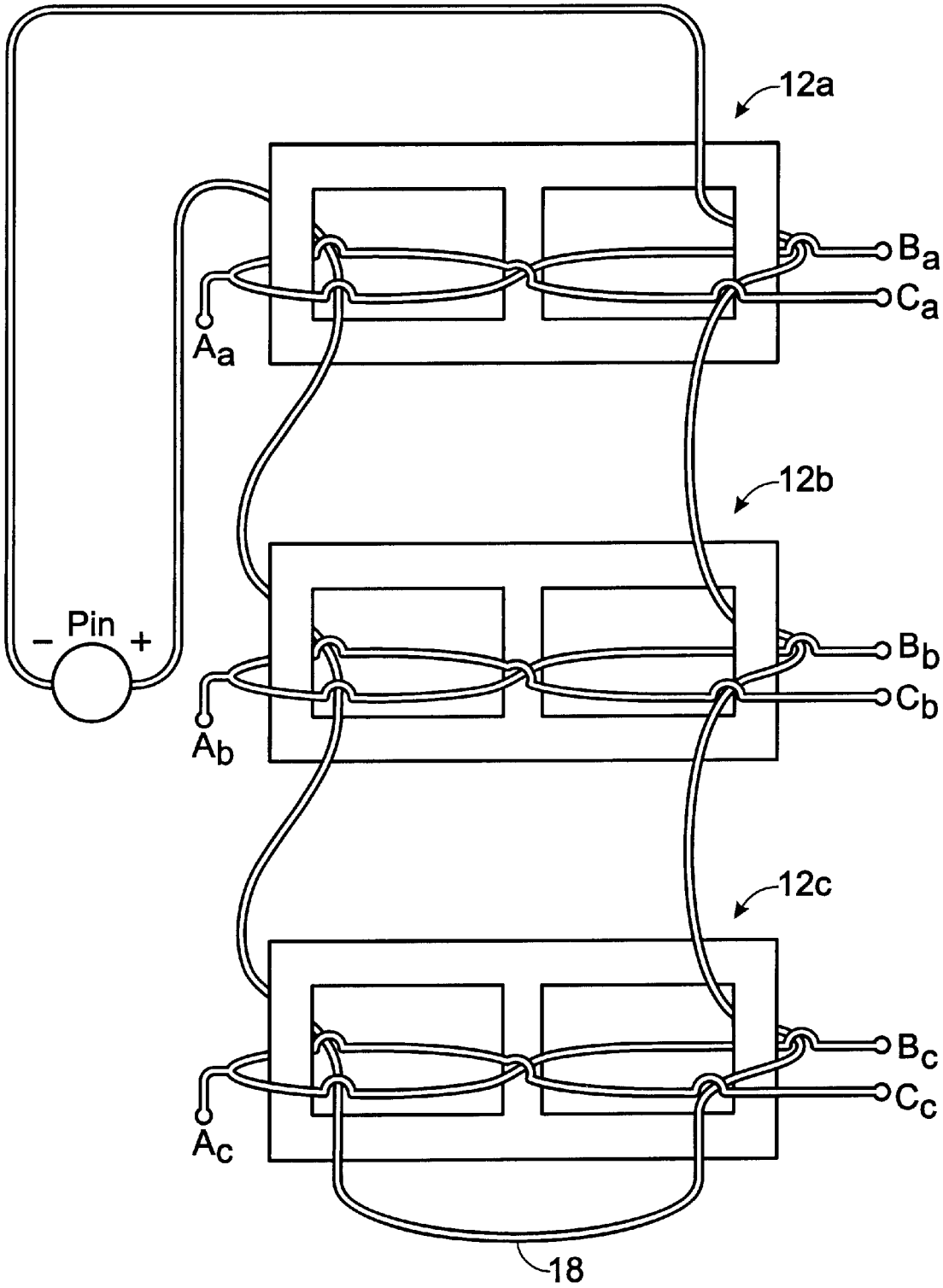
FIG. 9 is a pictorial schematic of a multiple core embodiment of the transformer of FIG. 6.
Figure 10:
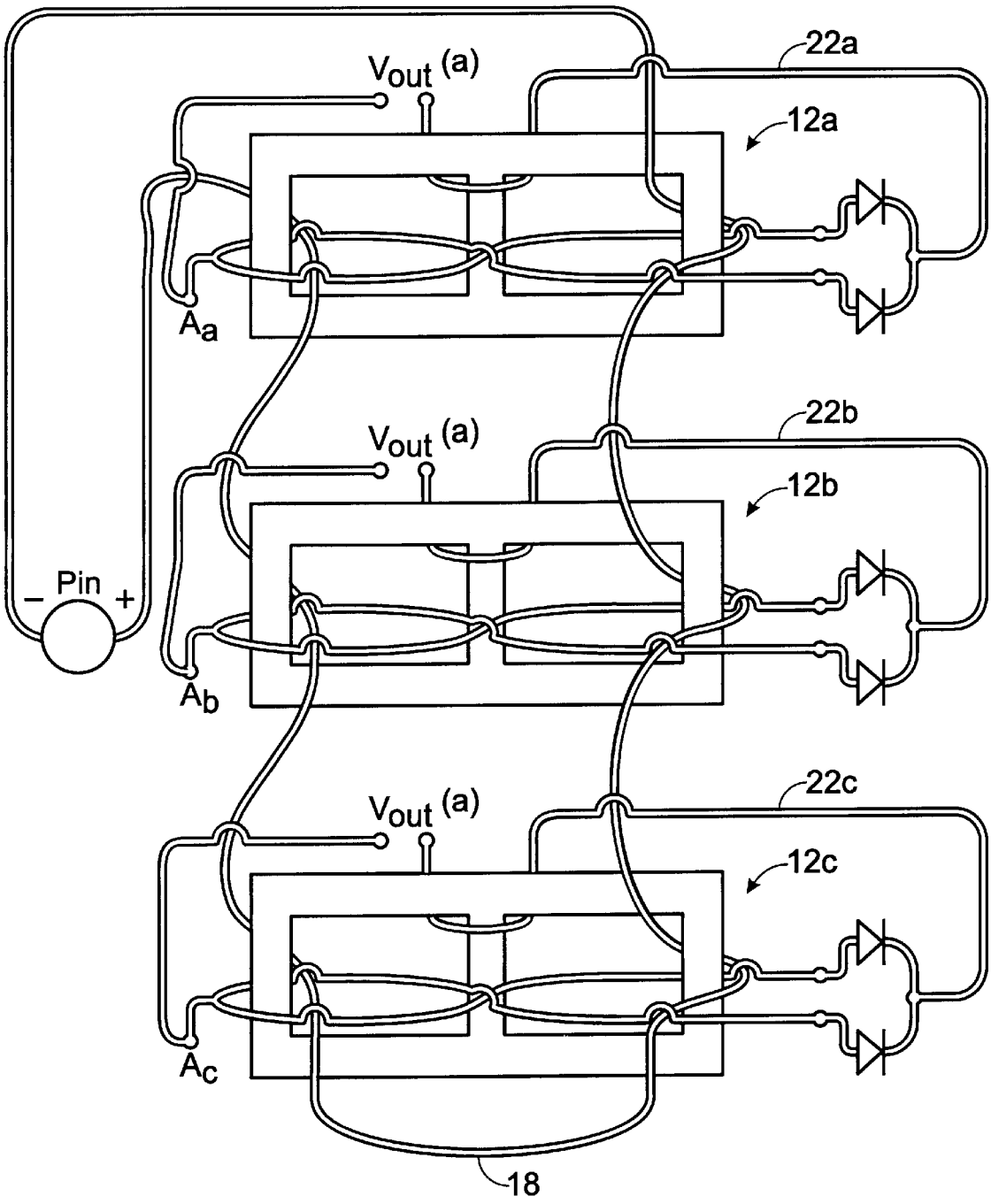
FIG. 10 is a pictorial schematic of a multiple core embodiment of the transformer of FIG. 7.

Turning to FIGS. 8–10, multiple core embodiments of the transformers (and circuits) of FIGS. 5–8, respectively, are shown according to the present invention. The multiple core embodiments are based on the principle that, where there are N cores 2 looped by the primary 18, the voltage induced in the secondary 19 is reduced by a factor of 1/N. For example, employing 3 cores 12*a*–12*c* as shown in FIG. 8, each with half-turn secondary loops 19*a*–19*c*, provides the same output voltage Vout as would a single core transformer employing a one-sixth-turn secondary. Similarly, FIG. 9 shows three cores 12*a*–12*c* having respective center taps Aa, Ab and Ac, with respect to respective outputs Ba, Ca, Bb, Cb, and Bc, Cc. In FIG. 10, a respective integrated output filtering chokes 22*a*–22*c* provide outputs Vout(a)–Vout(c), which may be connected in parallel to provided a single output voltage. FIG. 8 also shows the use of a secondary winding 19 that is looped around two of the leg portions, as mentioned above.

It is to be recognized that, while a particular transformer providing low output voltage has been shown and described as preferred, other configurations and methods could be utilized, in addition to those already mentioned, without departing from the principles of the invention.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

What is claimed is:

1. A transformer for providing a low output voltage, comprising:

a magnetic core having at least two apertures defining a center portion therebetween and two leg portions:

a primary winding having a first portion looped around one of said leg portions in either the right or left hand sense, and a second portion looped around the other leg portion in the opposite sense forming a power input; and a secondary winding having a first portion looped around one of said leg portions, said secondary winding having two ends forming a first power output.

2. The transformer of claim 1, wherein said secondary winding has said first portion looped a fractional turn.

3. The transformer of claim 1, wherein said first portion of said secondary winding is looped around one of the leg portions in either the right or left hand sense and around the remaining leg portion in the opposite sense, wherein a first node disposed on said secondary winding between said two ends forms a center tap with respect thereto.

4. The transformer of claim 3, further comprising a third winding looped around said center portion, said third winding having two ends, wherein said two ends of said secondary winding are coupled together to form a second node, wherein one of said ends of said third winding is coupled to said second node, and wherein the other end of said third winding forms a second power output with respect to said first node.

5. The transformer of claim 4, wherein said third winding is looped around said center portion a fractional turn.

6. A method for providing a low output voltage, comprising the steps of:

providing a magnetic core having at least two apertures defining a center portion therebetween and two leg portions:

providing a first portion of a primary winding as being looped around one of said leg portions in one of the right or left hand sense;

providing a second portion of said primary winding as being looped around the other leg portion in the opposite sense;

applying a power input to said primary winding;

providing a secondary winding having two ends;

providing a first portion of said secondary winding as being looped around one or both of said leg portions; and thereby providing a power output across said two ends of said secondary winding.

7. The method of claim 6, wherein said step of providing said first portion of said secondary winding as being looped around one of said leg portions provides said first portion of said secondary winding as being looped around said one of said leg portions a fractional turn.

8. The method of claim 6, further comprising providing said power input to be substantially greater than 3.3 volts, and providing said power output to be less than or substantially equal to 3.3 volts.

9. The method of claim 6, further comprising providing said first portion of said secondary winding to be looped around one of the leg portions in either the right or left hand sense and around the remaining leg portion in the opposite sense, and forming a center tap along said secondary winding between said two ends with respect thereto.

10. The method of claim 9, further comprising providing a third winding having two ends and being looped around said center portion, coupling said two ends of said secondary winding together to form a second node, coupling one of said ends of said third winding to said second node, and forming a second power output from the other end of said third winding, along with said first node.

11. The method of claim 9, further comprising providing a third winding having two ends and being looped around said center portion, coupling said two ends of said secondary winding together to form a second node, coupling one of said ends of said third winding to said second node, and taking a second power output with respect to said first node at the other end of said third winding.

12. The method of claim 6, further comprising providing at least one additional magnetic core having at least two apertures defining a center portion therebetween and two leg portions, providing said first portion of said primary winding as being looped around one of said leg portions of said at least one additional magnetic core in said one of the right or left hand sense, and providing said second portion of said primary winding as being looped around the other leg portion of said at least one additional magnetic core in the opposite sense.

13. The method of claim 12, further comprising providing said first portion of said secondary winding as being looped around said one or both of said leg portions in either the right hand or left hand sense, and providing a first portion of another secondary winding as being looped around one of said leg portions of said at least one additional magnetic core in the same said sense as said first portion of said secondary winding, said other secondary winding having two ends coupled in parallel to said two ends of said secondary winding.

* * * * *